US005102143A

United States Patent [19]

Winkelman

[11] Patent Number: 5,102,143

[45] Date of Patent: Apr. 7, 1992

[54] IN A TRADING GAME A "GAME AVERAGE" DEVICE

[76] Inventor: Martha Winkelman, 100 Kings Point Dr., Apt. 1602, N. Miami Beach, Fla. 33160

[21] Appl. No.: 451,452

[22] Filed: Dec. 14, 1989

Related U.S. Application Data

[63] Continuation of Ser. No. 887,908, Jul. 21, 1986, Pat. No. 4,913,446.

[51] Int. Cl.[5] ..... A63F 3/00

[52] U.S. Cl. ..... 273/240; 273/278; 273/288

[58] Field of Search ..... 273/278, 256, 240, 288

[56] References Cited

U.S. PATENT DOCUMENTS

| | | | |
|---|---|---|---|
| 2,691,528 | 10/1954 | Laidlau | 273/256 |
| 3,237,948 | 3/1966 | Murray | 273/256 |
| 3,397,890 | 8/1968 | Newton | 273/278 |
| 3,539,189 | 11/1970 | Shelton | 273/256 |
| 4,002,342 | 1/1977 | Biggs | 273/256 |
| 4,378,942 | 4/1983 | Isaac | 273/278 |

*Primary Examiner*—Benjamin Layno

[57] ABSTRACT

The preferred embodiment of this invention features a trading game in which some or all of the activities, features and events related to a stock exchange or the like, may be simulated for the enjoyment of 2 or more players. The game consists of 5 sessions and 3 steps in each session and it is played on a simple game board characterized by providing a distinct trading symbol in each of the playing spaces therein, for the players to select at least one trading symbol per turn to conduct simulated trading transactions. The value of the simulated investments represented therein are subject to change during the game and at game-end, the player accumulating the most play money over his/her start up funds, wins the game. This invention also provides a method of continuing playing, thereby linking together the 5 sessions game with a plurality of succeeding completed 5 sessions games. The game closes after every 5 sessions game and re-opens to run continuously over an undetermined period of time. The game may be played by up to a large and varying group of players. Each participant plays and finish his/her own game independently from each other. The player achieving the largest score on record is the current champion until another player betters this record score. A former player may better his/her previous score as a new player. The 5 sessions game may be played with or without employing the method of continuing playing.

1 Claim, 2 Drawing Sheets

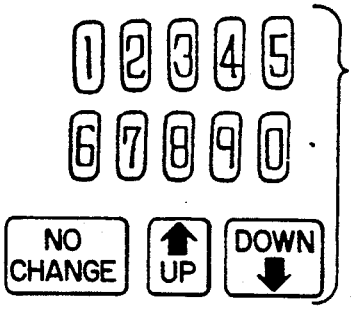
FIG. 2
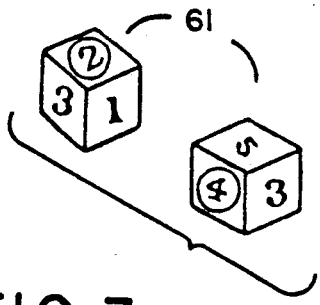
FIG. 3
FIG. 4
GAME AVERAGE
| TRADING SYMBOLS | QUOTATION OPEN (50) | QUOTATION CLOSE (52) | CHANGE (53) | |
|---|---|---|---|---|
| A | 100 | 130 | +30 | 54 |
| E | 100 | 100 | ... | |
| I | 100 | 88 | - 12 | 55 |
| O | 100 | 103 | + 3 | 54 |
| U | 100 | 94 | - 6 | 55 |
| | | TOTAL CHANGE | +15 | 56 |
OPEN 1000 (51) CHANGE +15 (58) CLOSE 1015 (57)

IN A TRADING GAME A "GAME AVERAGE" DEVICE

This is a continuing application of the applicant's first application Ser. No. 06/887,908 filed Jul. 21, 1986 now U.S. Pat. No. 4,913,446 "A Trading Game and Method for Continuing Playing" the entire disclosure of which is incorporated herein by this reference.

BRIEF SUMMARY OF THE INVENTION

This invention relates to a board game, and more particularly to a trading game in which diversified business and financial transactions involving chance and skill elements are simulated for the enjoyment of 2 or more players.

The invention is susceptible for practice in a variety of themes by making some adaptations of the preferred embodiment without departing from the scope of the invention, and thereby provide a competitive, interesting and challenging pastime.

A trading game based upon tangible properties, such as a bycicle, toys, other things, and intangible properties such as stocks and bonds, other investments appear best suitable for the theme and practice of this invention.

Accordingly, a trading game simulating a stock exchange or the like and also, a method of continuing playing have been fully developed for illustration herein of the preferred embodiment of this invention.

The game is provided and equipped to be played "with or without" employing the method of continuing playing.

The game of this invention provides a simple and functional game board having a plurality of paying spaces, with each of the playing spaces having a different trading symbol printed therein, providing means for the players to conduct simulated trading transactions in a game in which the player, in turn, makes all his/her investments decision. For example: the selection of a trading symbol to conduct simulated transactions is made by the player directly from the game board. The decision of whether to BUY or SELL, is also made by the player using his/her appropriate trading play piece. The player then places his/her trading play piece in the trading symbol's playing space of his/her choice on the game board regardless whether or not the selected trading symbol's playing space is occupied by other/s trading play piece/s.

The game of this invention is characterized by having designated number of the game trading symbols representing the "Game Average" components in combination with the Game Average indicia displayed in the center area of the game board. The game average components provide an indication of the combined price movement of the investments represented by the trading symbols' game average representative components. A game average record form including play instructions for determining the game average "closing" figure is provided with the game. The game average element provides a significant characteristic and entertainment feature in a family-type and party game simulating a stock exchange or the like.

An object of the preferred embodiment of this invention is to simulate the characteristics of a stock exchange or the like. Another object of this invention is to simulate a "Game Average" indicator being implemented in cooperation with elements employed in the play of the game. The game may be played with or without employing the "Game Average" indicator.

It is a further object of this invention to provide a trading game and a method of continuing playing.

The game of this invention has been provided to be played "with or without" employing the method of continuing playing.

The game of this invention has been equipped to keep track of the players portfolio holdings by means of the trading play pieces placed on the game board. Each player receives an equal amount of game currency at the start of the game. Simulated BUY and SELL transactions are settled during the game by means of the game currency. The trading play pieces, remaining placed on the board after the 5th session has been completed, are liquidated at game-end by each player, in turn. The player accumulating the most game currency over his/her start up game currency funds wins the game.

Reoord forms are not required to play a single or double game.

In summary, the trading play pieces and the game currency in combination with the play of the game provide means for determining a player's gain or loss score achieved during the game.

The game of this invention acquired novelty in its own merits and when the game is linked together with the method of continuing playing additional features and characteristics are made possible.

The method of continuing playing has been adapted to function with the game of this invention and provides a plurality of adapted record forms systematically linking together, one by one, the current completed game with the succeeding game to continue playing. The adapted forms contain the game elements indicia related to a player's score to be achieved during the play of a plurality of succeeding games, thereby establishing a "continuous" game contest to be played during an undetermined period of time and which may be played by up to a large group of players and by a varying number of players.

Another object of the game employing the method of continuing playing is to provide a "continuous" game contest whereby at the end of the game, the game closes and recesses to re-open and continue in the following succeeding game, and the "closing" prices of the simulated investments, represented by the game trading symbols, are carried over from the completed game and represent the "opening" prices during the first trading session of the succeeding game; and also, the Game Average "closing" figure is similarly carried over to represent the "opening" Game Average of the succeeding game.

The adapted record forms provided by the method of continuing playing may be used together with or may replace the use of some of the play pieces provided to play a SINGLE or DOUBLE game. Also, the combination of these record forms may replace the use of the gameboard. Other objectives and features of this invention will become apparent from the examination of the completed application, including the entire patent application disclosure.

BRIEF DESCRIPTION OF THE DRAWINGS

FIG. 2 is a plan view of a sample of informative play pieces, used to post current prices in the playing spaces on the board, with one digital, two digitals or more placed next to each other to form the required number. These informative play pieces are also used to post other game information in the center board spaces.

FIG. 3 illustrates a set of two special die being employed during the "Quotation Changes" period. The players may use only one said special die or both.

FIG. 4 illustrates a filled in "Game Average" record form.

DETAILED DESCRIPTION OF THE PREFERRED EMBODIMENT

Figure 1:
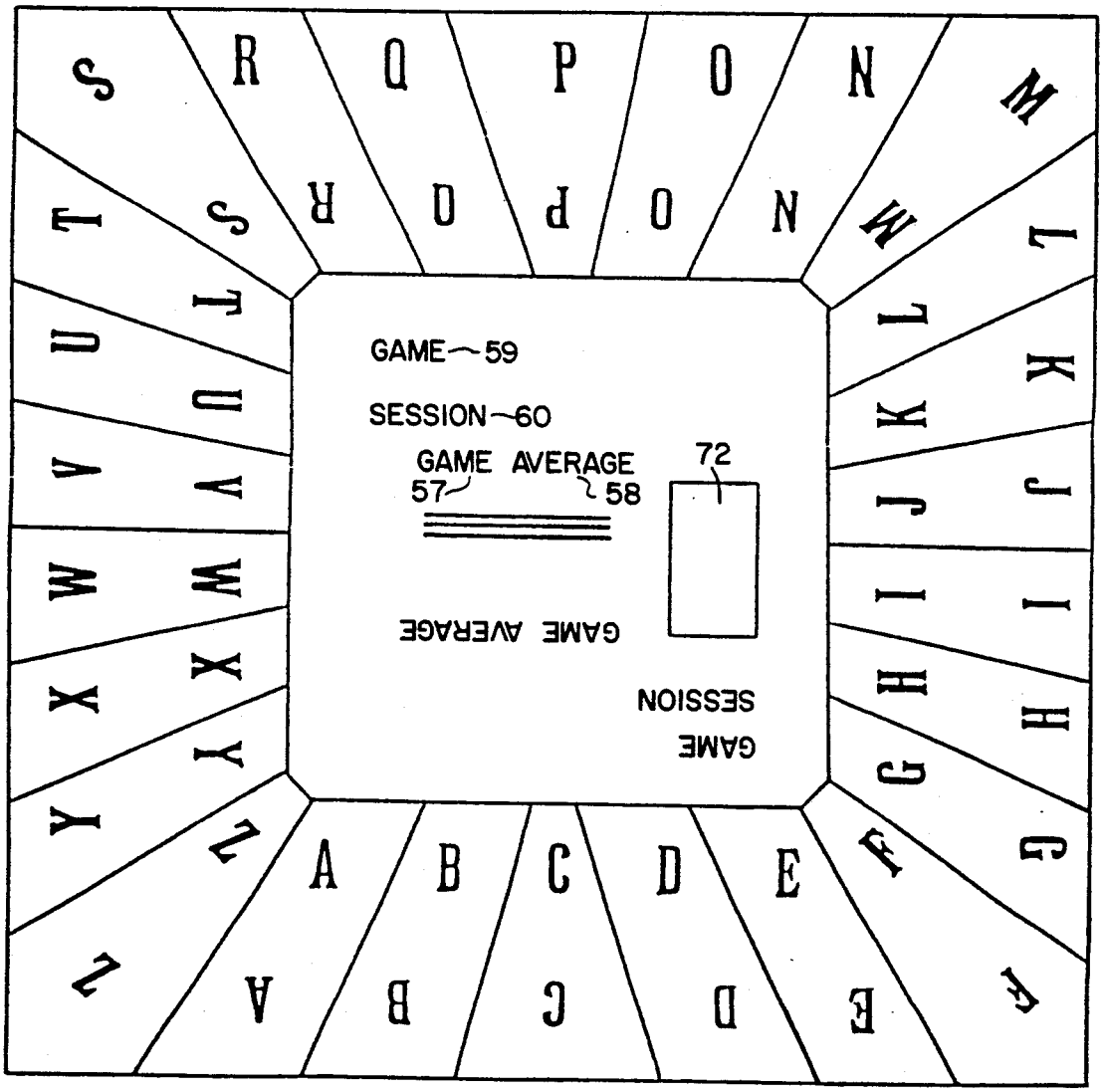
FIG. 1 is a plan view of an exemplary gameboard, with a designated playing surface in accordance with this invention.

The gameboard of the preferred embodiment FIG. 1 is of the usual rectangular shape and could be manufactured of cardboard or any other suitable material. The gameboard is characterized by providing trading symbols thereon. A different letter of a complete alphabet, printed in each of the playing spaces bordering a center area, represents the symbols means provided in said playing spaces. The center area of the board shows indicia related to the play of the game. The space 57 and 58 on the gameboard and opposite space thereon have been provided for the "Game Average" indicator, also referred to as the index. Space 72 is provided for the placement of the News cards used during the News Release period. Step No. 3.

The letter symbols provided in said gameboard serve as a "make believe" means wherefrom a player makes his/her selection and may buy or sell securities of a well known Corporation located anywhere in the world, as well as, investing in his/her neighborhood stores or any other business concern selected.

The players favorite Company's shares may be bought and sold during the play of the game. The initial of the Company's first name indicates the game trading symbol under which its stock is traded.

The indicator, also called the Game Average Index is provided by a designated number of the game trading symbols in the game board and represents significant characteristic in a family type and party game simulating a Stock Exchange or the like.

The game average record form FIG. 4C has been specially designed in conjunction with the designated trading symbols on the gameboard representing the Game Average index in combination with the play of the game, and provides a player with means for determining the "closing" Game Average figure FIG. 4. 57 and 58. For game purposes, the game average is determined as follows: you record the opening prices of each of the game average symbols index 50 and $100 per share. You also record the game average 1000 51 opening figure. At the end of the game, you record the closing price 52 of each of the game average symbols index and the price change 53 of each symbol, which is the difference between the closing and the opening prices. If the total of the plus changes 54 is larger than the total of the minus changes 55 the game average is increased by the difference 56. If the total of the minus changes 55 is larger than the total of the plus changes—the game average is decreased by the difference. The game average figures recorded in this form in the close 57 and change 58 spaces, are also the figures to be posted in the gameboard FIG. 1 Average Indicator 57 and 58 spaces.

After playing the 5th Quotation Changes round, any of the players may fill-in one Game Average form FIG. 4 as indicated above, and then post on the gameboard FIG. 1 57 and 58 space, the "closing" and "change" Game Average figure for the game played. When playing a DOUBLE game the "closing" prices FIG. 4 column 52 and bottom line 57 space filled-in at the end of the first game, are carried over to represent the "opening" prices 50 and "opening" Game Average figure 51 for the second game. Also, the players may predetermine to update the Game Average indicator after each Quotations Changes round using one Game Average form FIG. 4 for each round.

Trading play pieces, are used during the trading session. The preferred embodiment game is equipped with four sets of trading play pieces.

Game currency is provided and used during the trading session.

The informative play pieces, FIG. 2 are used during the Quotation Changes step to post changes of the prices of the stocks represented by the trading symbols on the board. The prices posted apply to both buy and sell transactions and the prices do not change until all the players have completed their trading turn during the same trading session. Each informative play piece bears a digital. The player places on, 2, or more digitals next to each other to form the required number. The informative play pieces are also used to post the Game Average figure 57 and 58 and the game 59 and session number in progress 60.

The trading play pieces and the informative play pieces FIG. 2 may be made of a plastic material. The shape of the play pieces may differ from those illustrated.

Special die, FIG. 3, a set of two die specially designed is provided with the game. One die bears the numbers 1, 2 and 3. The other die bears the number 3, 4 and 5. "plain" numbers indicate a plus value and the "encircled" numbers indicate a minus value. The value of the numbers appearing face up on the rolled die are to be combined. For example FIG. 3 shows a face up combination value of plus two 61.

News cards and FUN GRAM forms are employed during the News Release period variation and amusement to the play of the game.

STARTING THE GAME

The preferred embodiment is equipped for 2 to 4 players. The players may elect to play a single or double game.

One set of instructions for play, contained in a booklet, is to be followed by all the players alike during every step of the game.

STEP NO. 1—TRADING SESSION

For example, instructions for play may have been provided for as follows:

The starting price for the stocks represented by the 26 letter symbols on the gameboard is $100 per share.

A player, in turn, executes his/her trading transactions by means of his/her "buy" or "sell" trading play piece.

Each trading play piece has a quantity value of 100 shares. Each player shall use no more than two trading play pieces per turn, and may use his/her two trading play pieces in one transaction or may elect to make two different transactions. A player may only buy and sell shares in quantities of 100 or 200 per turn.

A player, in turn, may complete and close out any or all his/her trading transactions during the game, however he/she can not increase his/her trading allowance.

The value of his/her trading play pieces remaining placed on the board at game-end is included in his/her score.

At the end of the 5th session or 10th session in a double game, each player, in turn, liquidates his/her entire portfolio holdings, if any, using the "closing"-prices of the last session played.

When a player places his/her "buy" piece on the board, he/she pays the current price to his/her Acting Broker, who shall deposit the game currency bills in the "game funds" container.

As a player's places his/her "sell" play piece, he/she shall be paid the current price with "game fund" bills by his/her Acting Broker.

After all the players have taken their trading turns, the game proceeds with the Quotation Changes step.

STEP NO. 2—QUOTATION CHANGES

The roll of the dice FIG. 3 determines the price movement of the stocks represented by the letter symbols on the gameboard under which the stocks are traded.

Playing in the same order as in Step No. 1, each player calls out, one per turn, in alphabetical order, only the "traded" letter symbols on the gameboard. After a player calls a "traded" symbol, he/she rolls the two die once and then posts the resulting price in the letter symbol space accordingly, using the informative play pieces FIG. 2.

Instructions for play may also include how to play the game with variations within the scope of the invention.

The players may elect to call, roll the dice for, and change the price of any "non-traded" stock letter symbol during each Quotation Changes period.

STEP NO. 3—NEWS RELEASE PERIOD

All players, in turn, draw a card from the top of the fun news cards pile placed on the gameboard FIG. 1 72. If the card contains a fun message, the players return the card by placing it face down at the bottom of the pile. If the card contains a dividend or game currency message, the players keep the card till the end of the game for inclusion of its value in their score.

The players, in any order, may use the Fun-Gram forms to write in their own entertaining message to send to each other. When a player receives Fun-Gram message he/she should read it to the other players.

END OF THE GAME

The game ends after all the steps of session 5 in a single game, or session 10 in a double game, have been completed by all the players. The prices resulting form the last Quotation Changes period are the "closing" prices for the game.

The value of the players' trading play pieces remaining placed on the the board are included in their score.

The players take turns in liquidating their portfolio.

The "buy" trading play pieces are valued as Assets.

The "sell" trading play pieces as Liabilities.

A player receives the "closing" price for each of his/her "buy" trading play pieces remaining placed on the board. A player pays the "closing" price for each of his/her "sell" trading play pieces remaining placed on the board. A player also collects the monetary fun value of any News cards held by him/her at the end of the game.

Each player is assisted by his/her acting broker.

Each player then counts his/her game currency, and the player having achieved the largest gain wins the game.

From the foregoing disclosure, and including the entire patent application disclosure, it is apparent that the game of this invention provides a competitive and entertaining game for players with or without any knowledge of the world of finance, and that the multiple objectives of this game invention have been fully accomplished. It is to be understood that variations and changes may be made in the preferred embodiment of this invention to provide other type of games, without departing from the scope of this invention.

METHOD OF CONTINUING PLAYING

Hereafter, as a matter of clarification and where distinction is required, the game of this invention is referred to as the "5 sessions game" and when linked together with the method of continuing playing it is referred to as the "continuous game".

When employing the method of continuing playing the "5 sessions game" is played as previously disclosed in the foregoing specifications, systematically employing the combination of adapted record forms.

The method of continuing playing provides a "continuous game" contest formed by a plurality of succeeding "5 sessions games" to be played over an undetermined period of time and by a varying group of players. The "continuous game" closes at the end of every "5 sessions game " and re-opens in the following game for continuing playing with each of the contest elements having the same standing as held at the end of the previous 5 sessions game.

For example: trading symbols on the gameboard FIG. 1 "closing" quotations at game-end are carried over from one game to the next. Game Average closing figure 57 is also similarly carried over; and the player starts the next game with the same portfolio holdings number of shares held at the end of the previous completed game.

The adapted Record forms provided by the Method of Continuing playing may be used together with or may replace one or some of the play pieces provided to play SINGLE or DOUBLE game. Also, during the same game some players may be employing the play piece while other players may be employing the combined adapted Record forms.

CLOSING OF THE 5 SESSIONS GAME

Using the Record forms provided by the Method of Continuing Playing, the players follow instructions for play linking together, one by one, the completed game with the succeeding game.

ANOTHER 5 SESSIONS GAME

The game re-opens with the same quotations and Game Average figure as it had previously closed at.

Each 5 sessions game is played as previously disclosed using the play pieces to play a SINGLE or DOUBLE game or using the combination of adapted Record forms to continue playing.

A PLAYER FINISHES HIS/HER OWN GAME

Each player participating in the "continuous game" decides how many 5 sessions games to play. Each player plans his/her moves which offer the best means of winning the game independently from the other players. Each player liquidating his/her entire portfolio holdings with a profit wins the game. The player with the highest Actual Score on Record is the Champion until another player finishes his/her own game with a higher score.

A separate Championship Record form FIG. 8B is maintained for players participating in the 5 sessions game and for players participant in the continuous game of this invention.

The outlined detailed description of the 5 sessions game preferred embodiment of this invention and the continuous game version may be practiced together during the course of the same game.

It is to be understood that multiple variations of the features of the trading game of this invention and method of continuing playing have become apparent in the light of the foregoing disclosure. Any variations described within the foregoing specifications have been introduced as examples and are not be considered limiting in any way.

Accordingly, it is understood that the game of this invention may be practiced and the method of continuing playing to this invention, may be employed with changes and modifications from those that have been specifically disclosed herein; and that each specific term herein includes all technical equivalents which operate in a similar manner to accomplish a similar purpose, including the various features of novelty herein set forth, taken either singly or in combination and which have been introduced by means of illustrations and are not intended to be limiting in any way.

What is claimed is:

1. A game average device adding variation and amusement to the play of a game; the game providing a gameboard having a plurality of trading symbols, each one of them employed in the play of the game; said game utilizing a setting value means for repeatedly determining an upwards and downwards valuation changes related to said plurality of trading symbols; said game cooperatively providing a designated number of said plurality of trading symbols employed in the play of said game to also represent the game average device; said game average device providing means for recording an open, a close and a change valuation information being related to each of said designated number of trading symbols representing the game average device and the recorded valuation information being derived in cooperation with the setting value means being utilized during the play of said game; said game average device also providing means for arriving to a total valuation change resulting from the recorded valuation information in accordance with instructions for play; said game and said game average device further providing means for reporting a current game average figure to bring about a cooperative result which has been provided to said game whereby said game average device simulates a leading performance indicator of an actual financial market.

* * * * *